US005363168A

United States Patent [19]

Glover et al.

[11] Patent Number: 5,363,168

[45] Date of Patent: Nov. 8, 1994

[54] PHOTOGRAPHIC PROCESSING APPARATUS

[75] Inventors: Edward T. S. Glover, London; Anthony Earle, Middlesex, both of United Kingdom

[73] Assignee: Eastman Kodak Company, Rochester, N.Y.

[21] Appl. No.: 47,145

[22] Filed: Apr. 13, 1993

[30] Foreign Application Priority Data

Apr. 21, 1992 [GB] United Kingdom ..... 9208606

[51] Int. Cl.[5] ..... G03D 3/08; G03D 13/02

[52] U.S. Cl. ..... 354/319; 354/321; 354/331; 354/336

[58] Field of Search ..... 354/313, 318–322, 354/331, 336, 339, 324; 134/64 P, 122 P

[56] References Cited

U.S. PATENT DOCUMENTS 2,428,681 10/1947 Pratt et al. ..... 354/324
3,175,776 3/1965 Butterfield ..... 354/319 X
3,563,486 2/1971 Meeussen et al. ..... 242/67.1
3,641,910 2/1972 Smith ..... 354/319
4,311,380 1/1982 Cutter ..... 354/322

FOREIGN PATENT DOCUMENTS 0337174 10/1989 European Pat. Off. .
2183401 12/1973 France .

*Primary Examiner*—D. Rutledge
*Attorney, Agent, or Firm*—Frank Pincelli

[57] ABSTRACT

Helical processing paths are known for use in photographic processing apparatus. However, in known arrangements, the material to be processed is transported in a generally longitudinal direction along the helical path. Described herein is an improved path arrangement in which a spiral processing path (10) is utilized. The spiral processing path (10) is connected between an inlet (A) and an outlet (B), and forms a compact unit in which the material to be processed is transported with its edges in substantially in the same plane.

12 Claims, 5 Drawing Sheets

PHOTOGRAPHIC PROCESSING APPARATUS

BACKGROUND OF THE INVENTION

The present invention relates to photographic processing apparatus and is more particularly concerned with processing apparatus having at least one spiral processing path.

Photographic processing apparatus are well known in which the material being processed is transported along a helical path. Examples of such apparatus are described in *Research Disclosure,* November 1980, No. 19948, U.S. Pat. No. 3,968,510, U.S. Pat. No. 3,827,617, U.S. Pat. No. 3,823,859, U.S. Pat. No. 3,780,637, U.S. Pat. No. 4,025,937, U.S. Pat. No. 4,311,380 and EP-A-0 274 625.

The arrangement described in U.S. Pat. No. 3,827,617 comprises a helical web or film path processing device in which counteracting spools generate a force on the film which counteracts the normal tracking force generated as the film approaches a spool in a direction which is not perpendicular to the spool axis. The tracking force causes the film to climb the spool flanges, twist and fold over causing damage to the film.

The arrangements disclosed in *Research Disclosure,* November 1980, No. 19948 and U.S. Pat. No. 4,025,937 relate to porous conduit processors in which a transport strip or web is helically wound around the conduit. The material to be processed is inserted between the conduit and the transport strip or web, and is transported along the conduit with the strip or web.

U.S. Pat. No. 3,968,510 discloses another conduit arrangement in which a web to be processed is transported in a helical path. In this arrangement, the web is transported either by rollers or belts so that it is deflected by a helical rail or band wrapped around the conduit or by axially spaced radially extending protuberances which deflect the web along a helical path.

In U.S. Pat. No. 3,780,637, processing apparatus is disclosed in which a screw member having a helically disposed rib is utilized for retaining a flexible strip of photographic material for processing. The screw member is supported by a frame and is rotated about its axis when immersed in processing solution in a tank associated with the frame.

U.S. Pat. No. 3,823,859 discloses a processing rack which comprises a series of spools over which a web to be processed is threaded in a helical path. The spools are arranged in a tray having a plurality of semi-cylindrical cavities arranged in parallel side-by-side relation.

Apparatus for processing dental X-ray film is described in U.S. Pat. No. 4,311,380. The apparatus comprises a horizontally disposed processing chamber in which fluid retaining tanks are formed by lower portions of spiralling revolutions. The sidewalls of the chamber have grooves along which the film to be processed is driven through the chamber.

A processing device is described in EP-A-0 274 625 in which a plurality of long actuated guide forming elements are arranged in a processing liquid bath in a longitudinal direction. The material to be processed is transported through the processing liquid both along a helical guide path formed by the arcuated guide forming elements.

In all of the arrangements described above, the material being processed is transported in a longitudinal direction along a helical path. In each case, the apparatus is relatively bulky.

Furthermore, in some cases, means are arranged along the helical path to transport the material being processed along that path.

It is therefore an object of the present invention to provide photographic processing apparatus having a spiral processing path which is compact and does not suffer from the disadvantages mentioned above.

SUMMARY OF THE INVENTION

In accordance with one aspect of the present invention, there is provided photographic processing apparatus for processing photographic material, the apparatus comprising:

at least one processing tank;

a processing path within the processing tank;

an inlet to the processing path; and an outlet from the processing path;

characterized in that the processing path comprises a spiral;

and in that the material to be processed is transported along the processing path with its edges in substantially in the same plane.

By this arrangement, a long path length is obtained in compact form.

Advantageously, the processing path comprises an inlet portion and an outlet portion, the inlet portion and outlet portion each comprising a spiral and meeting at a junction at the center of the spiral, the inlet and outlet portions being interwoven to lie in substantially the same plane.

Preferably, the processing tank comprises the spiral processing path.

BRIEF DESCRIPTION OF THE DRAWINGS

For a better understanding of the present invention, reference will now be made, by way of example only, to the accompanying drawings in which.

DETAILED DESCRIPTION OF THE INVENTION

The present invention will be described with reference to the processing of photographic film. However, it will be readily understood that the invention can also be applied to the processing of other materials.

Figure 1:
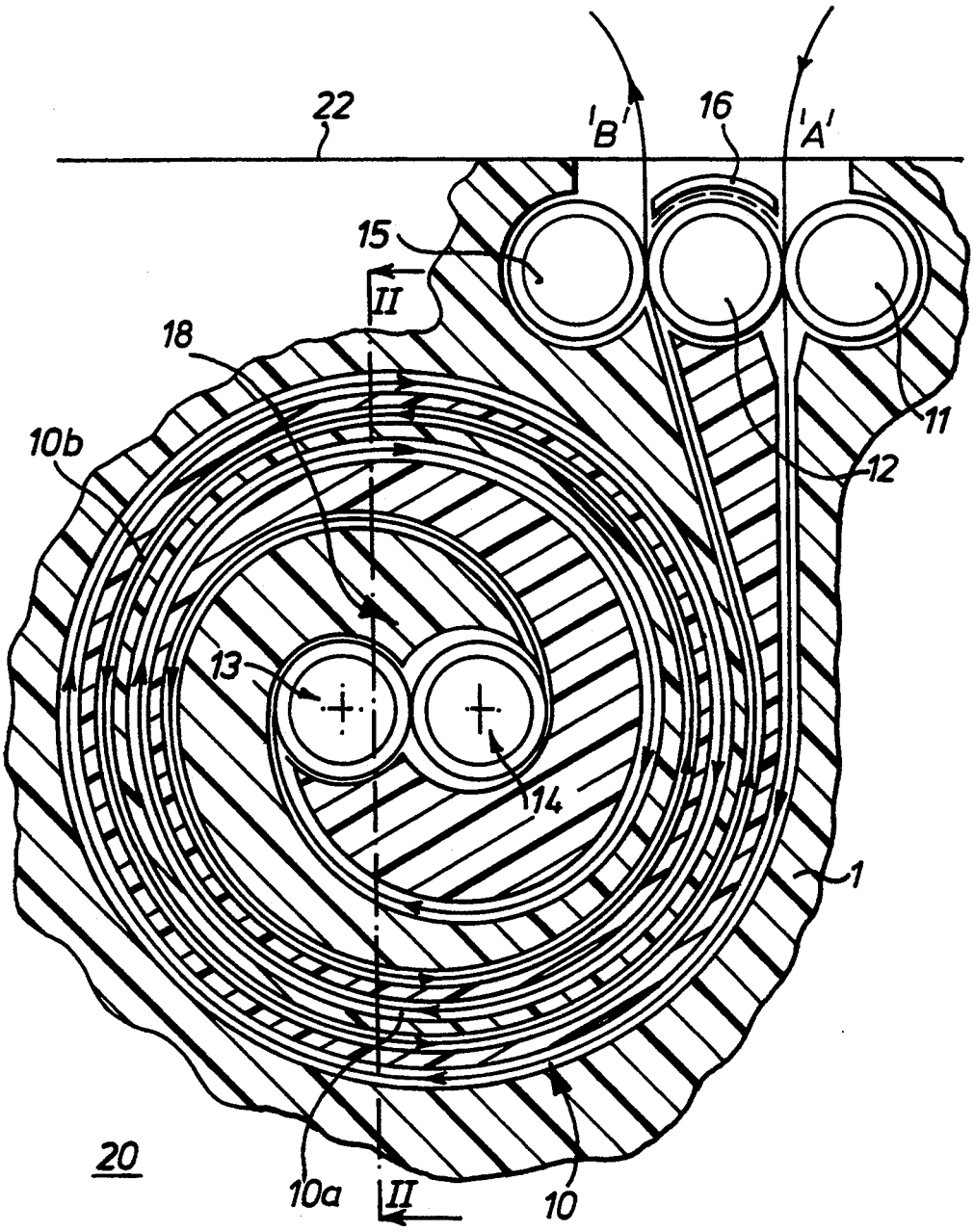
FIG. 1 illustrates a schematic cross-section through a portion of one embodiment of a photographic processor having a spiral path constructed in accordance with the present invention.

A portion of a processor is shown in FIG. 1, and comprises a block 1 in which spiral groove 10 is formed.

The block 1 is mounted in a water bath 20 contained in a processing tank (not shown) below a water level 22. The spiral groove 10 is connected between an inlet 'A' and an outlet 'B'. The inlet 'A' and outlet 'B' are defined by nip roller pairs 11, 12 and 12, 15 respectively.

The spiral groove 10 comprises an inlet portion 10*a* extending from the inlet 'A' to its center 18 and an outlet portion 10*b* extending from its center 18 to the outlet 'B'. As shown in FIG. 1, the inlet portion 10*a* and the outlet portion 10*b* of the spiral 10 are interleaved, and define a relatively long but compact processing path.

Processing solution (not shown) is pumped into the spiral groove 10 to form a processing tank which has a processing path in the form of a spiral. Film (not shown) is processed as it traverses the spiral path between the inlet 'A' and the outlet 'B'.

A pair of rollers 13, 14 are arranged at the center 18 of the spiral groove 10 to receive material arriving at the centre 18 and to direct the material away from the centre 18 and towards the outlet 'B'.

Rollers 13, 14 are used to turn the film around sharp corners as it approaches the center 18 of the spiral groove 10. Rollers 13, 14 are also used to maintain the speed of the film as it passes through the processor and to drive the film out from the centre 18 of the spiral groove 10.

Rollers 13, 14 are geared to the nip roller pairs 11, 12 and 12, 15 so that the film is driven at substantially the same speed.

Film is introduced into the inlet 'A' and is driven along inlet portion 10*a* of the spiral groove 10 by nip roller pair 11, 12. At the center 18 of the spiral groove 10, the drive for the film is taken up by rollers 13, 14 which, as mentioned above, drive the film out from the center 18 of the spiral groove 10 along outlet portion 10*b* to the outlet 'B'.

At the outlet 'B', the material may be directed to another stage in the processing apparatus or it may be re-directed into the inlet 'A' and into the spiral groove 10 for further processing. A guide 16 is movable to direct the material to the outlet 'B' or into the inlet 'A' (as indicated by the arrow shown in dotted lines).

Figure 2:
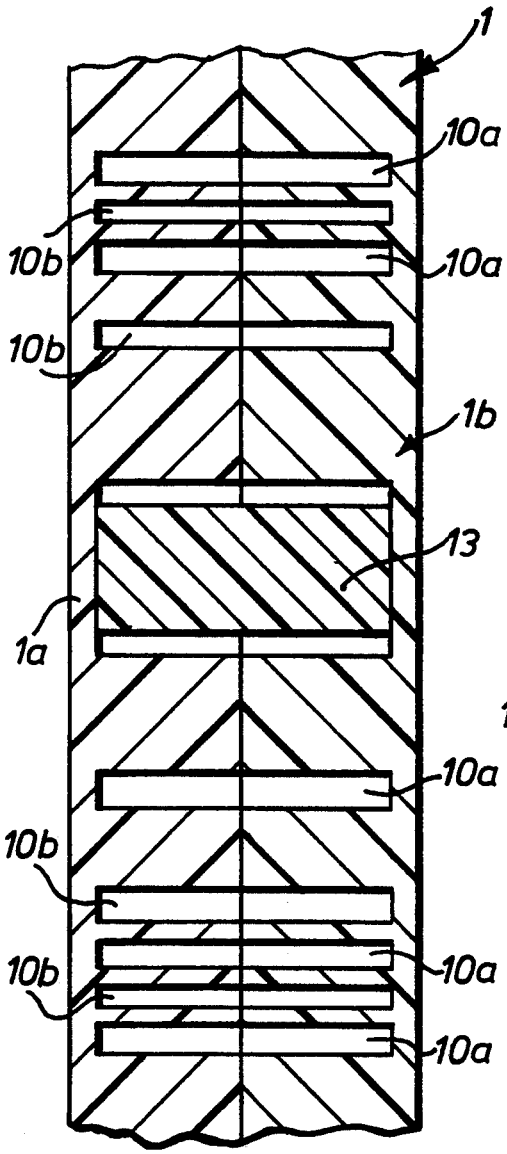
FIG. 2 is a sectioned view taken along lines II—II in FIG. 1.

Block 1 may be formed as a two-part molding as shown in FIG. 2. Each part of the molding 1*a*, 1*b* has a half of the spiral groove 10 formed therein so that when the two parts of the molding 1*a*, 1*b* are joined together the entire spiral groove 10 is formed.

Figure 3:
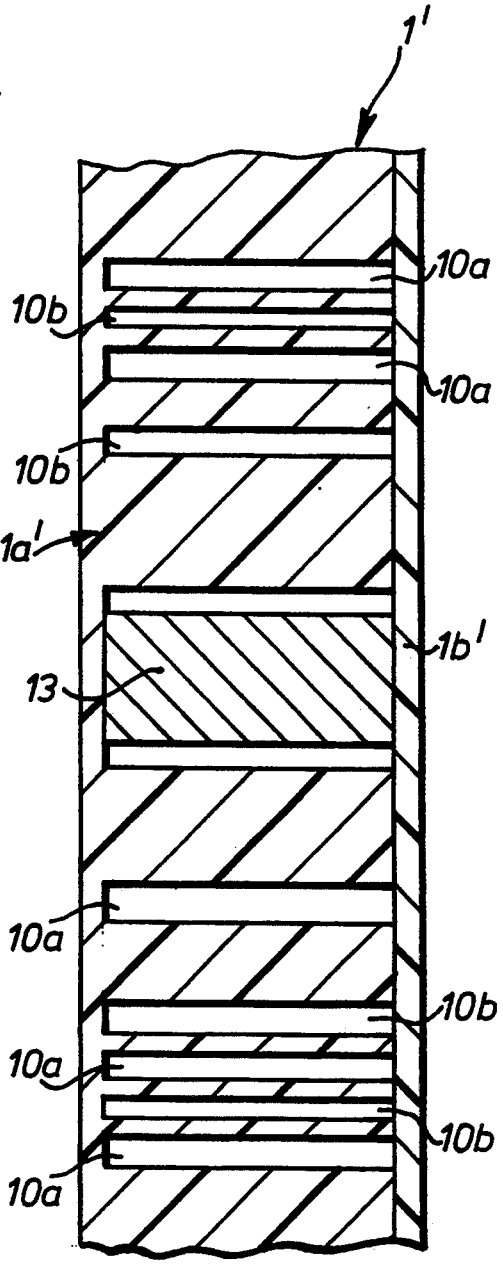
FIG. 3 is similar to FIG. 2 but illustrates another construction of a block defining the spiral path according to the present invention.

Alternatively, the block 1 may be formed by a molding portion 1*a*' including the spiral groove 10 and an end plate 1*b*' which closes off an end wall of the spiral groove 10 as shown in FIG. 3.

In each case, the draw angle for the molding is chosen so that there is no contact between the image area of the film and the portions of the molds defining the spiral groove 10.

Figure 4:
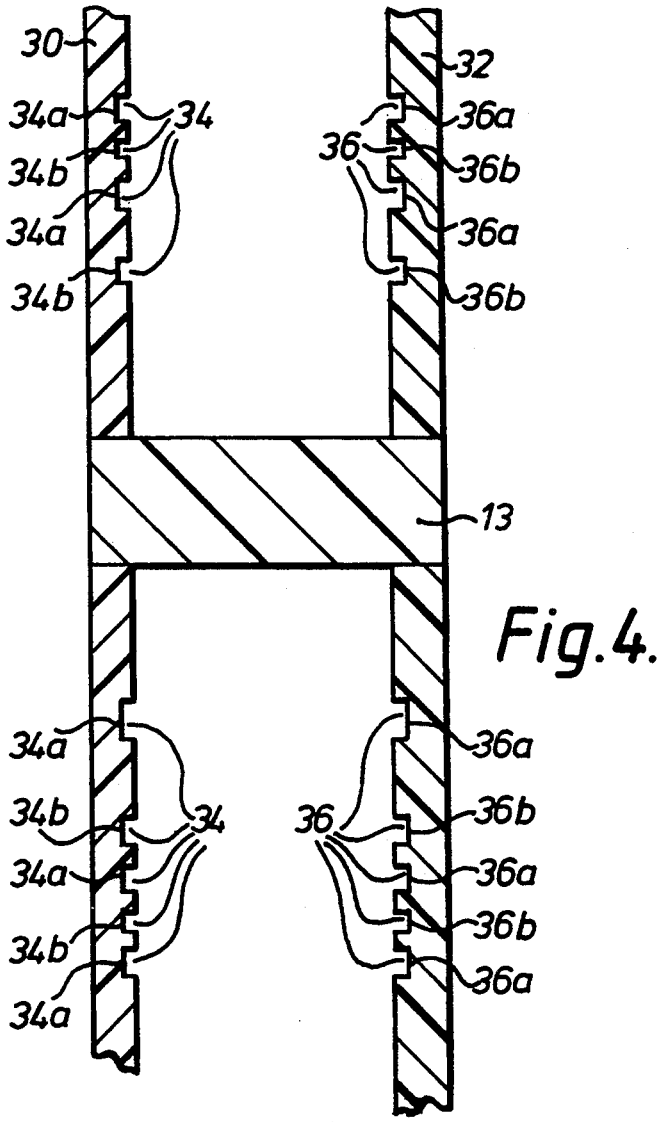
FIG. 4 illustrates a sectioned view taken through a portion of a second embodiment of a photographic processor constructed in accordance with the present invention.

As an alternative to block 1, the spiral processing path may be defined by two spaced apart plate portions as shown in FIG. 4. Here, the two plate portion 30, 32 are arranged facing each other at a distance suitable to accommodate the width of the film which is to be processed.

Each plate 30, 32 has a channel 34, 36 formed therein which defines one end of the spiral processing path, and along which the film (not shown) is guided by its edges. The channels 34, 36 each have a depth between 1 and 5 mm and are such that no contact is made with the image area of the film as it is transported along the spiral processing path defined by the plate portions 30, 32. As before, respective parts of the channels 34, 36 for an inlet portion 34*a*, 36*a* and an outlet portion 34*b*, 36*b* as shown in FIG. 4.

Film is transported along the spiral processing path by nip roller pair 11, 12, rollers 13, 14 at the center 18 of the spiral path and by nip roller pair 12, 15 and is guided by its edges in the channels 34, 36.

Figure 5:
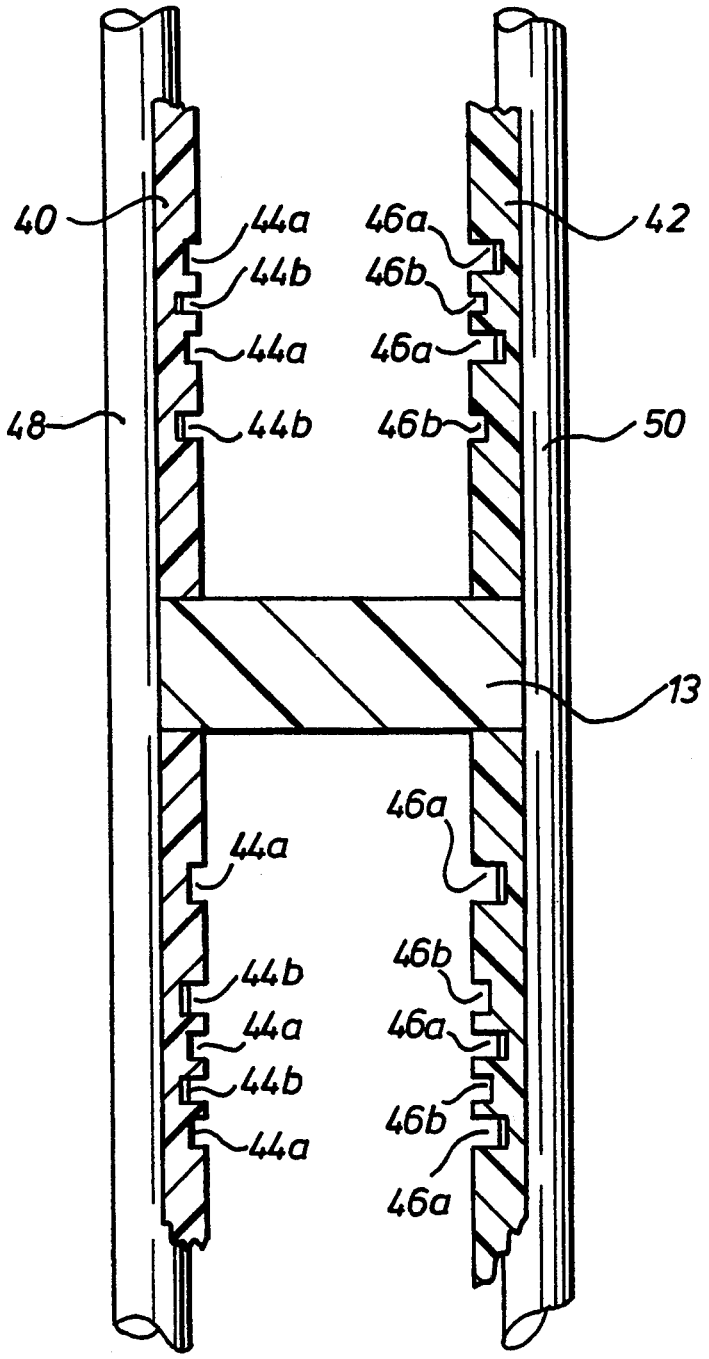
FIG. 5 illustrates one drive arrangement which can be used with the present invention.

However, it may be necessary to have further drive points other than at the inlet 'A' center 18 and outlet 'B' according to the length of the film material to be processed. One such arrangement is shown in FIG. 5.

As before, the spiral processing path is defined by two plate portions 40, 42 each having respective channels 44, 46 formed therein. In this case, the channels 44, 46 are formed such that the inlet portions 44*a*, 46*a* are slightly offset from the outlet portions 44*b*, 46*b*, that is, on plate portion 40 the inlet portions 44*a* are not as deep as the outlet portions 44*a* and on plate portion 42, the inlet portions 46*a* are deeper than the outlet portions 46*b*.

Cylindrical drive rollers 48, 50 are provided to impart drive to the film as it traverses the spiral processing path. Drive roller 48 is arranged to engage the edge of the film on the outlet portion of the spiral processing path and drive roller 50 is arranged to engage the edge of the film on the inlet portion of the spiral processing path. A part (not shown) of each plate portion is modified to accept the drive rollers 48, 50 and to allow them to make contact with the edge of the film being processed.

Portions of the molding described with reference to FIGS. 1 to 3 can be modified to include the cylindrical drive rollers as described above.

Figure 6:
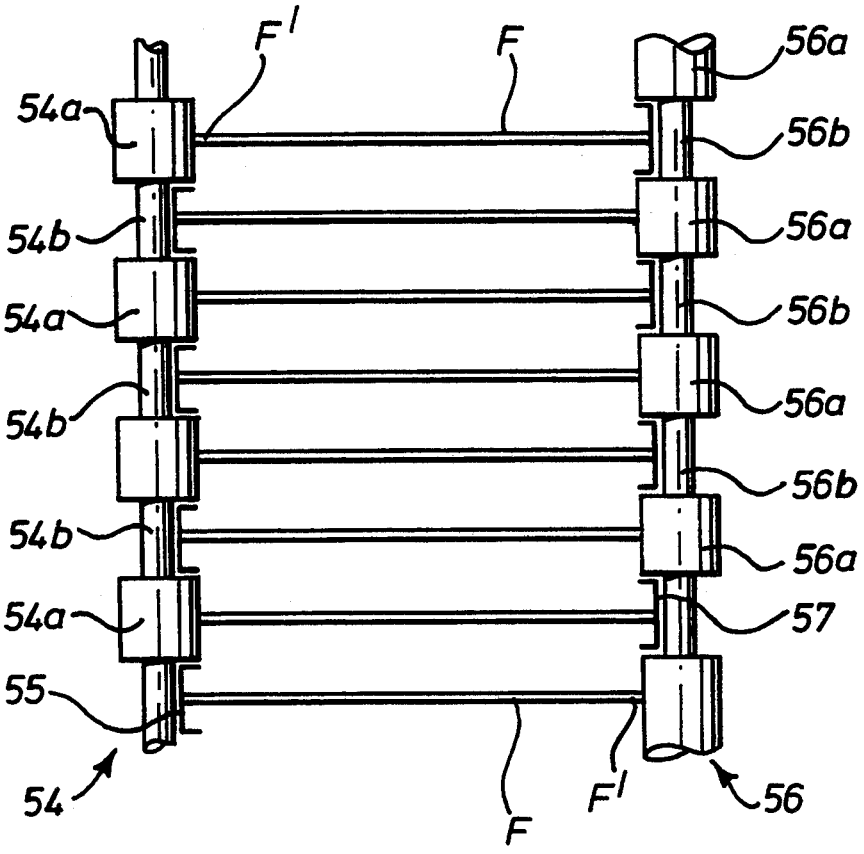
FIG. 6 illustrates a second drive arrangement which can be used with the present invention.

FIG. 6 illustrates another drive arrangement which can be used to assist transportation of the film along the spiral processing path. In this arrangement, a pair of castellated rollers 54, 56 are employed. Each roller 54, 56 is arranged so that the high points 54*a*, 56*a* of each roller is aligned with the low points 54*b*, 56*b* of the other roller as shown in FIG. 6. Film F is then driven by an edge F' by the high points 54*a*, 56*a* of each roller 54, 56. In order to prevent rubbing of the other edge of the film F not being driven, guide elements 55, 57 are provided in the low points 54*b*, 56*b* of each roller 54, 56 as shown.

Figure 7:
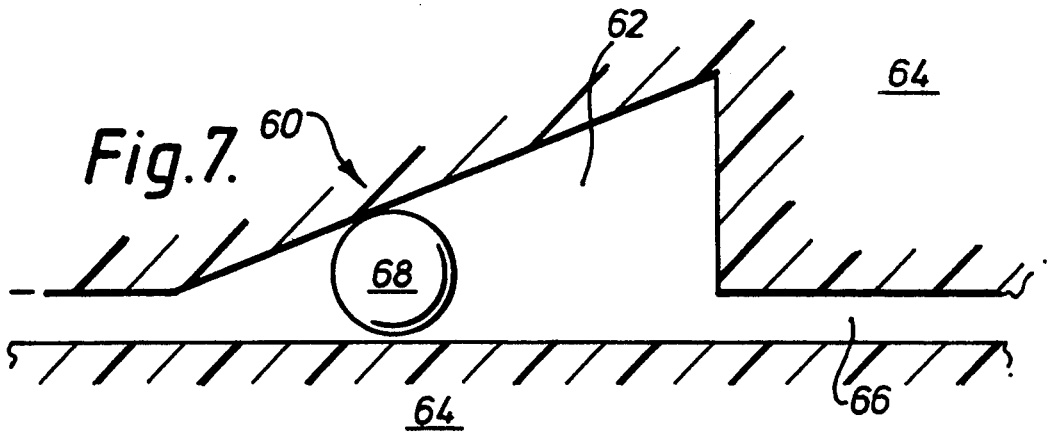
FIG. 7 illustrates an enlarged schematic view of a third drive arrangement which can be used with the present invention.

As an alternative to the cylindrical drive rollers 48, 50 and the castellated drive rollers 54, 56, a clutch arrangement 60, as shown in FIG. 7, can be used for unjamming the film if it should become stuck as it is driven along the spiral processing path by nip roller pair 11, 12, central roller 13, 14 and nip roller pair 12, 15.

The clutch arrangement 60 comprises a wedge-shaped aperture 62 formed in plate portion 64 adjacent channel 66, and a ball bearing 68 is located within the aperture 62. Operation of the clutch arrangement 60 is achieved by angularly moving the opposed plate portion (not shown) relative to plate portion 64. This causes the ball bearing 68 to move up and down the wedge-shaped aperture 62 pushing the film along with it. The relative angular movement imparted to the plate portions is between 4° and 5°.

Furthermore, the ball bearing 68 of the clutch arrangement 60 need not necessarily be a ball, that is, spherical, but may form a cylindrical roller which operates in the same way.

It is to be noted that the clutch arrangement of FIG. 7 can also be incorporated into the molding portion 1*a*' or either one of molding parts 1*a*, 1*b* as described above. In this case, a suitable coupling arrangement is required to allow the necessary relative movement.

More than one clutch arrangement may be required according to the length of the spiral processing path, and in particular the distance to and from the centre.

Naturally, the embodiments shown in FIGS. 4 and 5 are capable of being inserted directly into a tank containing processing solution as there is no closed processing path.

The spiral processing path obtained with the plate portions as described with reference to FIGS. 4 and 5 can be further defined by the inclusion of two spacers which are inserted into additional channels which are not occupied by the film. Each spacer is used for respective ones of the inlet and outlet portions of the spiral processing path. In this case, processing solution may need to be directly introduced into the spiral processing path.

The processor shown in the Figures can be used to process either discrete lengths of film material. In this case, the film material can be recycled around the spiral processing path any number of times. This number may be determined by elapsed time or by external detecting means, for example, a densitometer, which measures the amount of processing carried out on the material.

Alternatively, the processor can be operated as a continuous processor and process any length of film material—even lengths which exceed the path length of the spiral processing path.

Film may be processed in a particular photographic processing apparatus which comprises one or more such spiral processing paths, the film passing through each spiral in turn, each one representing a different stage in the process.

The arrangement described above produces a compact, low volume processing rack with a long path length being wound into a spiral.

Furthermore, the spiral may form the processing tank itself and the solution in which it is mounted may be merely a water bath to retain the solution retained in the spiral at the correct temperature.

Naturally, the present invention is not limited to use with photographic processing apparatus and its use can be extended to other types of web handling and treatment.

We claim:

1. Photographic processing apparatus for processing photographic material, the apparatus comprising:

at least one processing tank;

a processing path within the processing tank;

an inlet to the processing path; and an outlet from the processing path;

characterized in that the processing path comprises a spiral and the inlet and the outlet lie in substantially the same plane;

in that the material to be processed is transported along the processing path with its edges in substantially in the same plane; and wherein the processing path comprises an inlet portion and an outlet portion, the inlet portion and outlet portion each comprising a spiral and meeting at a junction at the center of the spiral, the inlet and outlet portions being interwoven to lie in substantially the same plane; and connecting means provided at the junction between the inlet portion and the outlet portion for reversing the direction of transport of the material.

2. Apparatus according to claim 1 wherein the connecting means comprises a pair of rollers located at the center of the processing path.

3. Apparatus according to claim 1, wherein the inlet to the processing path is defined by a pair of rollers.

4. Apparatus according to claim 3, wherein the outlet to the processing path is defined by a pair of rollers.

5. Apparatus according to claim 4, wherein the inlet and outlet to the processing path utilize three rollers, one roller being common to both the inlet and the outlet.

6. Apparatus according to claim 1, wherein the processing path is defined by a moulding.

7. Apparatus according to claim 1, wherein the processing path is defined by a pair of spaced apart plate portions.

8. Photographic processing apparatus for processing photographic material, the apparatus comprising:

at least one processing tank;

a processing path within the processing tank;

an inlet to the processing path; and an outlet from the processing path;

characterized in that the processing path comprises a spiral;

and in that the material to be processed is transported along the processing path with its edges in substantially in the same plane, wherein the processing path comprises an inlet portion and an outlet portion, the inlet portion and outlet portion each comprising a spiral and meeting at a junction at the center of the spiral, the inlet and outlet portions being interwoven to lie in substantially the same; and connecting means provided at the junction between the inlet portion and the outlet portion for reversing the direction of transport of the material.

9. Apparatus according to claim 8, wherein the connecting means comprises a pair of rollers located at the center of the processing path.

10. Photographic processing apparatus for processing photographic material, the apparatus comprising:

at least one processing tank;

a processing path within the processing tank;

an inlet to the processing path; and an outlet from the processing path;

characterized in that the processing path comprises a spiral;

and in that the material to be processed is transported along the processing path with its edges in substantially in the same plane, wherein the inlet to the processing path is defined by a pair of rollers; and wherein the processing path comprises an inlet portion and an outlet portion, the inlet portion and outlet portion each comprising a spiral and meeting at a junction at the center of the spiral, the inlet and outlet portions being interwoven to lie in substantially the same plane; and connecting means provided at the junction between the inlet portion and the outlet portion for reversing the direction of transport of the material.

11. Apparatus according to claim 10, wherein the outlet to the processing path is defined by a pair of rollers.

12. Apparatus according to claim 11, wherein the inlet and outlet to the processing path utilize three rollers, one roller being common to both the inlet and the outlet.

* * * * *